US006282394B1

(12) United States Patent
Sakai et al.

(10) Patent No.: US 6,282,394 B1
(45) Date of Patent: Aug. 28, 2001

(54) TONER DEVELOPING DEVICE FOR AN IMAGE FORMING APPARATUS

(75) Inventors: Takashi Sakai; Atsushi Inoue; Hiroshi Tatsumi, all of Nara; Takayuki Yamanaka, Tenri, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/408,277

(22) Filed: Sep. 29, 1999

(30) Foreign Application Priority Data

Oct. 13, 1998 (JP) ..... 10-290459

(51) Int. Cl.[7] ..... G03G 15/08
(52) U.S. Cl. ..... 399/281
(58) Field of Search ..... 399/272, 281

(56) References Cited

U.S. PATENT DOCUMENTS 5,781,838 * 7/1998 Suzuki ..... 399/281

FOREIGN PATENT DOCUMENTS 61-028978A 2/1986 (JP) .

* cited by examiner

*Primary Examiner*—William J. Royer

(57) ABSTRACT

In a mono component toner developing device, a developing roller supporting and conveying the mono component toner is arranged in contact with a photoreceptor supporting a static latent image. A supplying roller is arranged opposing the developing roller with a predetermined contact depth. The supplying roller has a pair of driven gears fixed at both ends of the rotational shaft thereof for being rotated so as to be meshed with a pair of driving gears rotated by a driving motor. The rotational force of the driving gears, acting at a coupling position, is used to deflect the supplying roller toward the developing roller side, whereby the supplying roller is pressed in approximately uniform contact with the developing roller across its full length along the shaft.

5 Claims, 5 Drawing Sheets

TONER DEVELOPING DEVICE FOR AN IMAGE FORMING APPARATUS

BACKGROUND OF THE INVENTION (1) Field of the Invention

The present invention relates to a developing device which performs development of a static latent image formed on a static latent image bearer with a toner as the coloring agent, and in particular, relates to a developing device using a developer as the toner composed of a mono component.

(2) Description of the Prior Art

An image forming apparatus using electrophotographic technology, such as a copier, a printer, has a developing device which, in order to visualize the static latent image formed on the surface of a photoreceptor as a latent image bearer, supplies a developer, such as toner or other coloring agents, to the photoreceptor and allows the toner to selectively adhere to the latent image.

In this developing device, the static latent image formed on the photoreceptor is developed and then the thus developed toner image is transferred to a sheet of paper as a printing material. On passing the transfer step, part of the toner which could not transfer to the sheet remains on the photoreceptor. This unnecessary leftover toner is removed from the photoreceptor in order to perform a next image forming operation. Therefore, a cleaning device for removal of the leftover toner from the photoreceptor is arranged downstream of the transfer station, and the unnecessary toner removed by this cleaning device is collected into a collecting portion in the cleaning device.

With a trend of image forming apparatuses having a developing device of the above type toward being compact, the space for arrangement of the processing devices for image formation around the photoreceptor needs to be reduced. So there is also a strong demand for a compact developing device.

In particular, the developing device for a dual component developer consisting of a toner and a magnetic carrier includes a magnetic brush type developing roller which conveys the dual component developer to the developing area facing the photoreceptor by the function of magnetism. In this developing device, the developer after development is collected into a developing hopper. Therefore, inorder to achieve a stabilized development, it is necessary to control the ratio of the toner contained in the developer, i.e., the toner concentration, so as to be constant, by re-supplying the toner being consumed.

Usually, for the developing device of the above type, i.e., using magnetic brush development, the carrier occupies a large volume in the developer, needing a large developing hopper for storing the developer, which leads to enlargement of the whole developing device. In addition, this type not only needs to control the toner concentration but also to have a multiple number of agitating means, for keeping the amount of electric charge on the toner in the developer uniform, which becomes the bottleneck for the downsizing of the developing device of this type.

In contrast, developing devices which perform development using a mono component developer, that is, only the toner as the developer with no carrier, have been proposed. In such a developing device using a mono component toner, there is no longer necessity to control the toner concentration, and the volume of the developer hopper can be markedly reduced because of the absence of carrier, making it possible to make the developing device compact.

In addition, the mono component developing device is simple and excellent in maintenance. Specifically, the maintenance of the developer is simplified because the developer does not need to be replaced due to the carrier's degradation.

Control as to the toner also can be simplified because only the toner needs to be re-supplied while no toner concentration detection and hence its control will be needed. Particularly, in a developing device using a mono component toner, the only thing to be done is to re-supply the toner when it is needed.

For example, as shown in FIG. 3 opposed to a photoreceptor 1 as an image bearer is a developing device 4 for visualizing a static latent image formed on photoreceptor 1. In this developing device 4, a rotatable developing roller 41 is arranged so as to oppose the opening of a developer hopper 40 holding a toner 10, the mono component developer. This developing roller 41 is exposed in part to the opening of developer hopper 40 and arranged so as to be in contact with photoreceptor 1. This contact area will be the developing area.

Developing roller 41 supports the mono component toner on the surface thereof and conveys it to the developing area opposing photoreceptor 1. After development, the toner which has not been used for development is conveyed into developer hopper 40 and collected therein. The collected toner is once removed from the developing roller surface. For this purpose, a supplying roller 42 is provided in press contact with developing roller 41 so as to scrape the toner supported on the developing roller surface. This supplying roller 42 also functions to newly supply the toner to the developing roller surface.

The mono component toner is supplied by supplying roller 42 and adheres to the developing roller surface. In order to regulate the adhered amount, a regulating means 43 is arranged in pressing contact with the developing roller surface. The toner after having passed through regulating means 43 is regulated as to its amount and reaches the developing area where the toner opposes and is in contact with photoreceptor 1 as stated above. In this area, the toner selectively adheres to the static latent image formed on the photoreceptor surface, thus development is carried out.

Usually, a developing bias voltage (Va) is applied to developing roller 41 in order to perform beneficial development. This developing bias voltage is set at a level that allows the toner to adhere to the static latent image and no toner to adhere to the background area (the background with no image) on the photoreceptor.

By the above configuration, the mono component developer, or the toner is made to adhere to the developing roller and conveyed to the developing area so that the toner adheres to the static latent image on the photoreceptor while no toner will adhere to the background area other than the latent image, performing correct development.

The amount of toner adhering to developing roller 41 is limited by regulating means 43 as stated above. For this toner amount regulation, that is, in order to stabilize the amount of toner and stabilize the amount of charge on the toner, the supplying and tribo-charging of the toner by supplying roller 42 is of importance. Therefore, supplying roller 42 is pressed appropriately against developing roller 41, SO as to perform correct supplying and tribo-charging of the toner.

In this case, if the contact pressure against developing roller 41 varies, supplying and tribo-charging of toner 10 by supplying roller 42 fluctuates making correct development impossible. Particularly, supplying roller 42 is rotatably supported at both ends of its rotational shaft by means of bearings, so that the contact pressure of supplying roller 42 against developing roller 41 may differ between the middle area and the extreme end areas. Usually, the contact pressure tends to become low in the middle area. For this reason, toner supplying and toner's charge distribution become uneven due to variations in contact pressure along the direction of the rotational shaft, resulting in inability of stabilization of the toner concentration in the whole area.

Disclosed in Japanese Patent Application Laid-Open Sho 61 No.28978 is a supplying roller 42 for supplying developing roller 41 with the toner, which has a crowned configuration, having the maximum diameter at the center and the minimum diameter at both ends so as to realize approximately uniform contact pressure across the full length of the supplying roller 42 being in press contact with developing roller 41. With this configuration, supplying and charging of the toner can be made uniform along the axial direction, realizing a stabilized development.

As stated above, when supplying roller 42 is pressed against developing roller 41, formation of a crowned supplying roller 42 and abutment of it with an appropriate pressure stabilized supplying and uniform charge of the toner, thus enabling stabilized development. In this case, a more stable charge performance can be expected if the contact pressure between supplying roller 42 and developing roller 41 is set higher.

On the contrary, a stronger contact pressure imposes an increased load torque on the developing device, which means the necessity of greater driving torque for rotation of supplying roller 42. As a result, a driving motor. capable of producing a high driving torque is needed, leading to it being costly and enlargement of the developing device including the driving motor. Further, setting of a high contact pressure will promote wear of supplying roller 42, shortening the life of the developing device.

To avoid this, load torque needs to be reduced, that is, the contact pressure of supplying roller 42 against developing roller 41 may be weakened. However, this cannot be attained without no compromise in tribo-electrification performance and stability of toner supplying. That is, lowering of tribo-electrification performance and instability of toner supply causes image unevenness and white voids. To solve these problems, a crowned supplying roller 42 may and should be formed, but the fabrication is very difficult and hence the cost is greater. Further, the provision of a crowned supplying roller increases the driving torque.

SUMMARY OF THE INVENTION

In view of the above problems, it is therefore an object of the present invention to provide a developing device for a mono component toner, which can realize stable toner supplying and stable tribo-electrification of the toner, without increasing contact pressure between the developing roller and supplying roller, hence with a reduced load torque.

The present invention has been devised in order to attain the above object, and the invention is configured as follows:

In accordance with the first aspect of the present invention, a mono component toner developing device, includes:

a developing roller supporting and conveying the mono component toner to a developing area opposing a static latent image bearer; and a supplying roller disposed opposing the developing roller on the side opposite to the developing area for supplying the toner to the developing roller, and is characterized in that the supplying roller has a pair of driven elements arranged at both ends of the rotational shaft thereof for being rotationally driven while a pair of driving elements to be coupled with corresponding driven elements to transmit a rotational force thereto are coupled with the driven elements at a position where the driving elements urge the driven elements in the direction opposite to the opposing point between the developing roller and supplying roller.

In accordance with the second aspect of the present invention, the mono component toner developing device having the above first feature is characterized in that the supplying roller is rotationally driven in such a direction that its peripheral movement is opposite to that of the developing roller at their opposed point, and each driving element and driven element are coupled in such manner that, when a coupling angle $\theta$ is the angle defined at the shaft center of the supplying roller by a line joined between the shaft center of the supplying roller and the shaft center of the developing roller and the coupling point between the driving element and the shaft center of the driven element, the coupling angle $\theta$ of the driving element is set so that $180° \leqq \theta \leqq 360°$ where the coupling angle when the coupling point resides on the line and on the side opposite to the developing roller is 0°.

In accordance with the third aspect of the present invention, the mono component toner developing device having the above first feature is characterized in that the driving element is coupled with the driven element at a point on a line passing through the shaft center of the supplying roller and being perpendicular to the line joined between the shaft centers of the developing roller and the supplying roller.

In accordance with the fourth aspect of the present invention, the mono component toner developing device having the above first feature is characterized in that the supplying roller is configured of an elastic foam material having many pores therein with a cellular density of pores falling within 80 to 100 cells/inch.

In accordance with the fifth aspect of the present invention, the mono component toner developing device having the above fourth feature is characterized in that the hardness of the supplying roller is lower than that of the developing roller and is set within a range from 60 degrees on Asker F basis to 30 degrees on Asker C basis.

Next, the operation of each configuration of the present invention will be described.

First, in the first configuration, the supplying roller is rotated in order to supply the toner to the developing roller. In this case, the supplying roller is held by bearings while the driving elements are coupled with the driven elements provided at both ends of the rotational shaft, further outward than the bearings, so that the supplying roller is urged in the direction opposite to the developing roller by the action of the rotational force of the driving elements. As a result, the supplying roller deflects toward the developing roller side with respect to the bearings as its fixed supports. The deflection becomes maximum around the middle part of the supplying roller, so the supplying roller abuts the developing roller as if it were in reality crowned.

In this way, since the supplying roller no longer needs to be formed beforehand in a crowned configuration, its manufacturing can be markedly simplified and reduced in cost. Further, since it is no longer necessary to enhance the pressing force of the supplying roller against the developing roller without the necessity of providing a crowned configuration, the driving torque, that is, the load torque for rotating the supplying roller becomes smaller, thus making it possible to drive the supplying roller with a motor having a small driving torque as well as making the device compact.

In the second configuration, as shown in FIGS. 1A and 1B, if the driving element (47) is coupled with the driven element (46) at a position downstream of the contact point between the two rollers with respect to the rotational direction of the supplying roller, below the line (AB) passing through the shaft center (A) of the developing roller (41) and the shaft center (B) of the supplying roller (42), a force having a magnitude of F0 and being directed to the rotational direction of the driving element acts on the supplying roller (42). Therefore, as shown in FIG. 2A, the supplying roller (42) deflects toward the developing roller (41) side with respect to the bearings (45) as its fixed supports so that the supplying roller (42) abuts the developing roller (41) in the same manner as in the crowned configuration. This configuration provides stable toner supply and stable toner electrification Next, in the third configuration, FIG. 1B shows a state where the driving element (47) is coupled at the coupling point (B7) with the driven element (46). The coupling angle (θ) in this state is set at 270°. The force F0 acting on the driven element (46) while the driving element (47) is rotating is directed in parallel with the line (AB). Therefore, the deflection in the middle portion of supplying roller (42) is maximized. As a result, the pressing state against the developing roller (41) is optimized so that it is possible to realize a uniform pressing state across the full length of the shaft even if the pressing force between the two rollers is set smaller. As a result it is possible to further reduce the driving torque.

In the fourth configuration, it is possible to further stabilize the toner supply to the developing roller. When the supplying roller has a large cellular density, it becomes difficult for toner particles to enter the pores, thus inducing toner supply failures. On the other hand, if the roller has a smaller cellular density, toner particles enter the pores and cannot be removed, so that the elastic foam material hardens, increasing the driving torque. Therefore, the above limitation of the cellular density makes it possible to stabilize the toner supply and inhibit the increase of the driving torque. Further, it is possible to solve the problem of the toner clogging the foam material as well as to continuously maintain the effect of removing the toner adhering to the developing roller, after development.

Next, in the fifth configuration, the limitation as to the hardness of rollers secures a sufficient contact state between the rollers, so that it is possible to maintain stable supply of the toner and removal of the toner after development and also inhibit the increase of the driving torque.

Here, since the supplying roller is rotated so that its peripheral movement is opposite to that of the developing roller in the opposed area, the removal effect of the toner remaining on the developing roller after development is enhanced. Though the driving torque of the supplying roller increases due to the drivings in opposite directions, increase in driving torque can be inhibited by setting the rotational speed of the supplying roller, that is, its peripheral speed, at a speed which is lower than that of the developing roller. Yet, there is some tendency toward insufficient supply of the toner to the developing roller. This can be prevented by applying a bias voltage to the supplying roller so as to urge the toner to the developing roller in order that the toner can readily transfer to the developer roller.

DESCRIPTION OF THE PREFERRED EMBODIMENTS

Figure 1A:
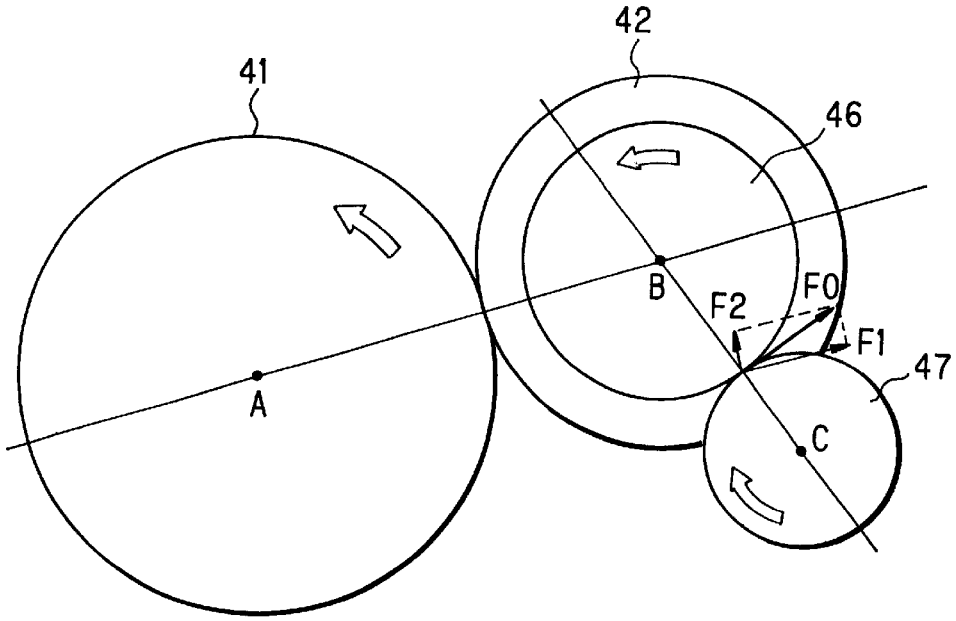
FIGS. 1A and 1B are diagrams showing driving states of a supplying roller in the first embodiment of the present invention, for supplying toner to a developing roller as a part of a developing device of a mono component toner in accordance with the present invention.
Figure 1B:
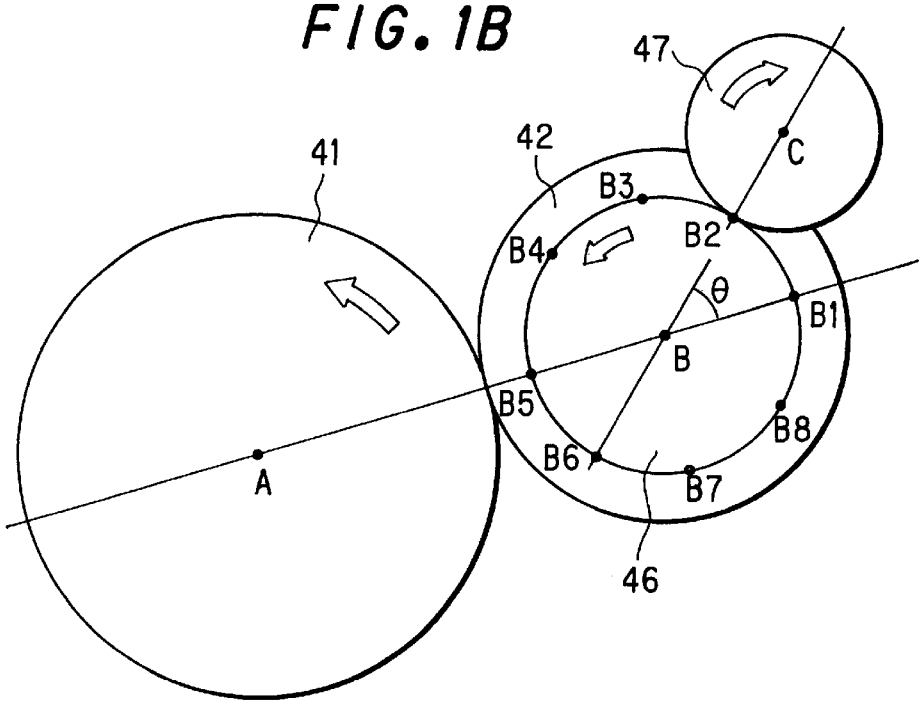
Figure 2A:
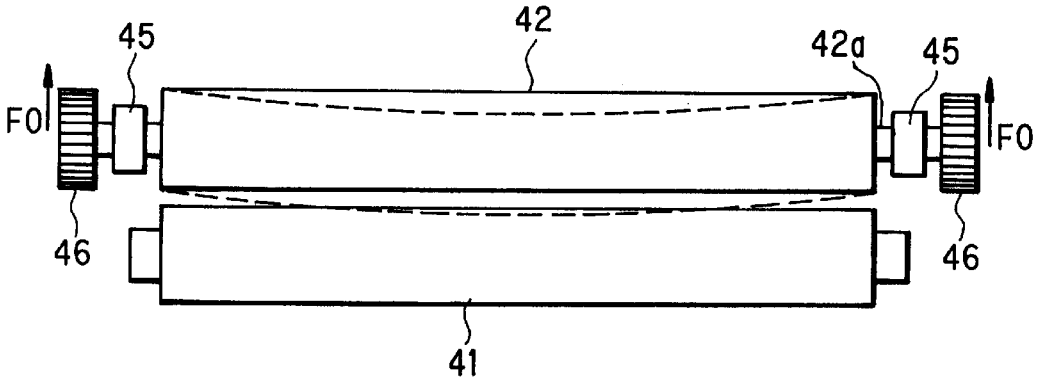
FIGS. 2A and 2B are diagrams for illustrating the states of the supplying roller in press contact with the developing roller in relation with the drivings of the supplying roller shown in FIGS. 1A and 1B, respectively.
Figure 2B:
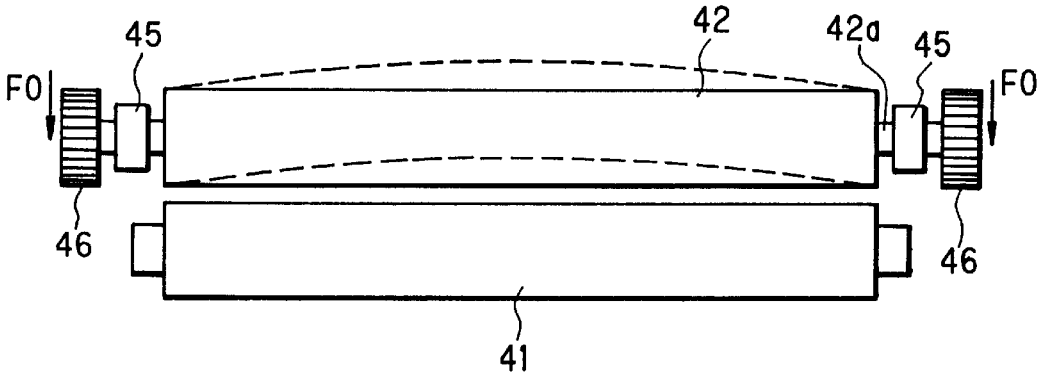
Figure 3:
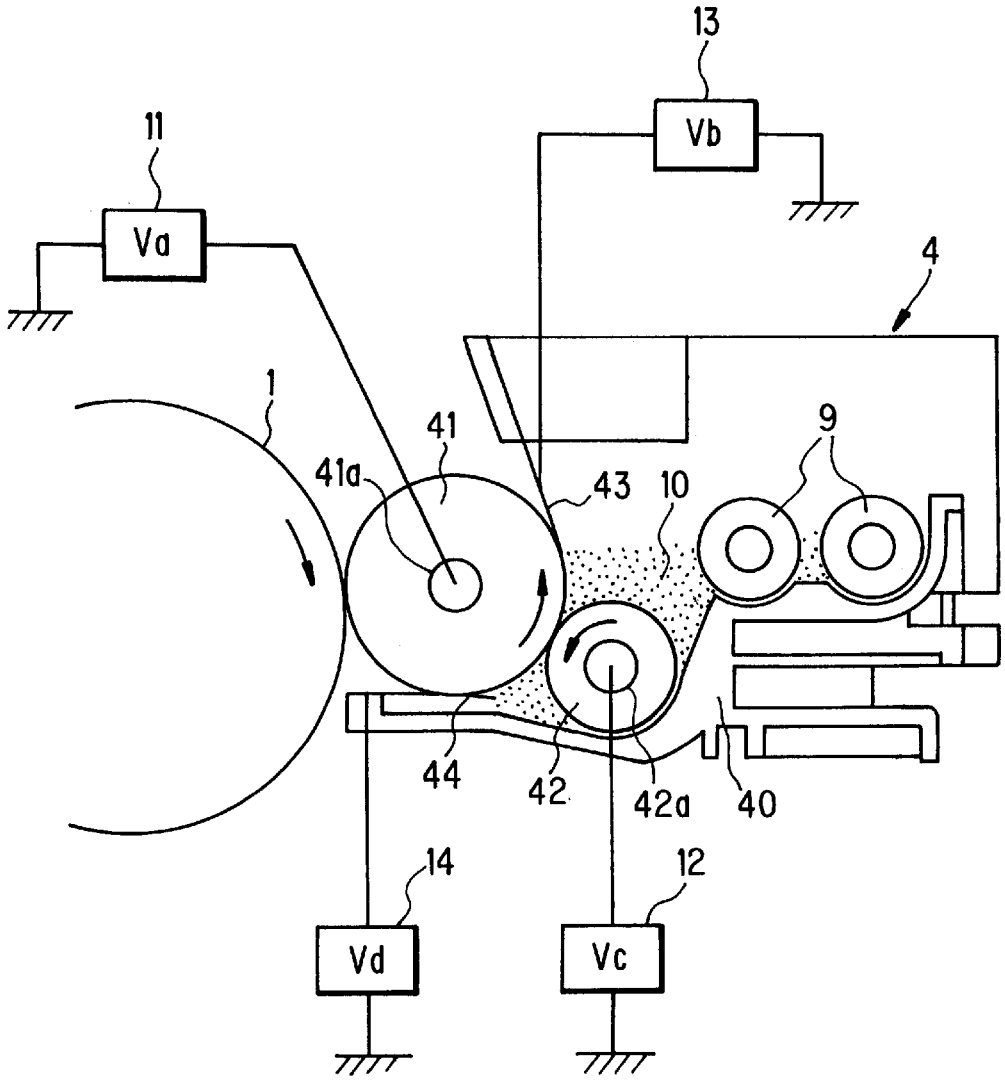
FIG. 3 is a sectional view showing a configurational example of a developing device using a mono component toner of the present invention.
Figure 4:
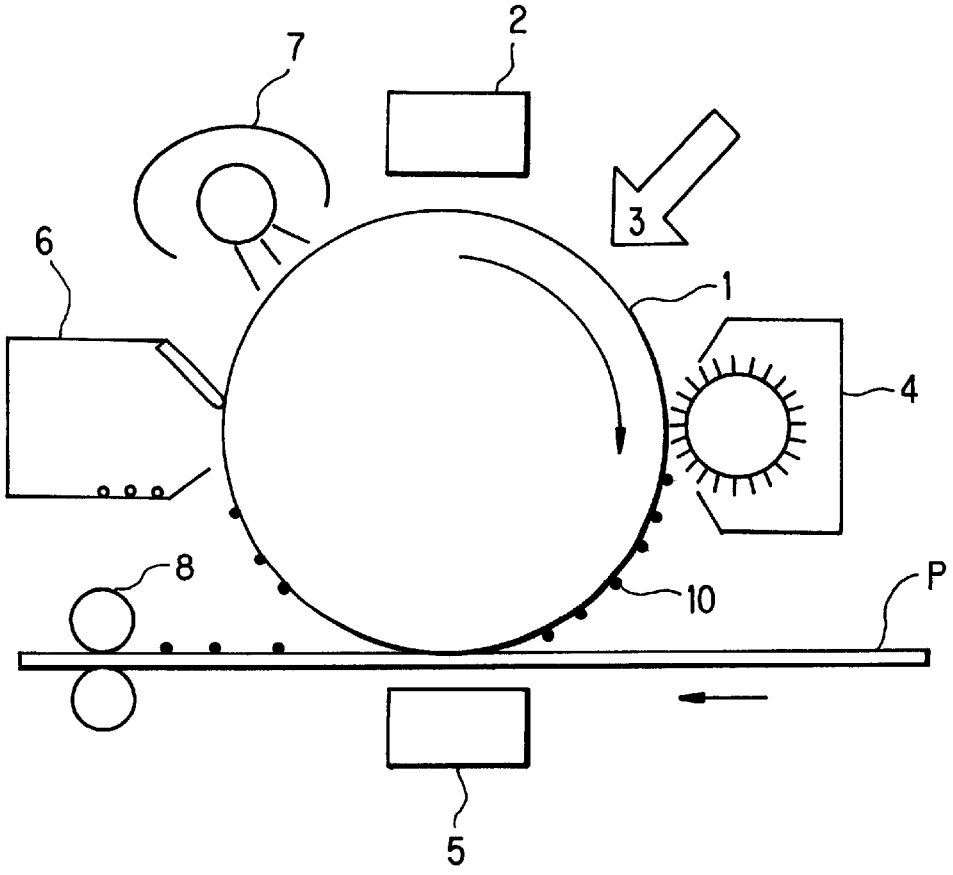
FIG. 4 is a schematic view showing an overall configuration of an image forming apparatus having the developing device shown in FIG. 3.

The embodiments of the invention will hereinafter be described in detail with reference to the accompanying drawings. One embodiment of a developing device of the present invention will be described with reference to FIGS. 1A and 1B to FIG. 4. FIGS. 1A and 1B are diagrams showing the relations between the developing roller and supplying roller during driving, both being parts of a developing device of the present invention, arranged opposite the photoreceptor as a latent image bearer of an image forming apparatus. FIGS. 2A and 2B are illustrations during operation showing the states of the supplying roller acting on the developing roller in the driving relations in FIGS. 1A and 1B. FIG. 3 is a view showing a configuration of a developing device of the present invention. FIG. 4 is a schematic view showing an overall configuration of an image forming apparatus having a developing device of the present invention shown in FIG. 3.

Referring first to FIG. 4, the schematic configuration of an image forming apparatus will be described. Designated at 1 is a drum shaped photoreceptor which is arranged in the approximate central portion of the image forming apparatus as an image bearer for supporting a static latent image and is rotationally driven at a constant rate in the direction of the arrow during image forming. Various image forming processing means are arranged opposing and around this photoreceptor 1.

The means (devices) constituting the image forming process include: a charger 2 for uniformly charging the photoreceptor surface; an unillustrated optical system radiating a light image 3 in accordance with the image to be formed; a developing device 4 of the present invention for visualizing the static latent image formed on the photoreceptor surface by exposure of the optical system; a transfer device 5 for transferring the developed image (image of toner 10) to a sheet of paper P being appropriately conveyed; a cleaning device 6 for removal of the leftover developer (toner) which has been untransferred and is residing on the photoreceptor surface after transfer; and an erasing device 7 for eliminating static charge remaining on the photoreceptor surface, all being arranged in the mentioned order with respect to the rotational direction of photoreceptor 1.

A large number of sheets P are stacked on a tray or cassette, for example, and the paper is fed one by one from the stack by means of a paper feeding means to the transfer area where the aforementioned transfer device 5 is located opposing photoreceptor 1 so that the leading edge of the sheet is synchronized with the leading edge of the toner image formed on the photoreceptor surface. Sheet P after transfer is separated from photoreceptor 1 and fed into a fixing device 8.

Fixing device 8 fixes the unfixed toner image, just transferred onto the sheet, as a permanent image, and includes a heat roller, which faces the toner image surface and is heated to a temperature so as to fuse and fix the toner, and a pressing roller which is pressed against the heat roller so as to bring paper Pinto close contact with the heat roller. Paper P having passed through fixing device 8 is discharged by discharging rollers to an unillustrated output tray outside the image forming apparatus.

The aforementioned unillustrated optical system, if the image forming apparatus is a copier, illuminates the copy original with light so that the reflected light from the original is focused as light image 3 on the photoreceptor. Alternatively, when the image forming apparatus is a printer or a digital copier, the optical system radiates a light image by switching a semiconductor laser on and off in accordance with the image data. Particularly, in a digital copier, the reflected light from the copy original is picked up by an image pickup sensor (CCD elements) so that the picked up image data is input to the optical system which includes a semiconductor laser, thus outputting a light image corresponding to the image data. In a printer, the optical system converts the image data from another processor, e.g., a word processor, personal computer, into a light image, and irradiates the photoreceptor with it. The conversion into the light image can also be carried out by an LED device, liquid crystal shutter, in place of a semiconductor laser.

In this arrangement, once an image forming operation is started in this image forming apparatus, photoreceptor 1 is rotationally driven in the direction of the arrow and the photoreceptor surface is uniformly charged by charger 2 to a predetermined potential of a specified polarity. After charging, the aforementioned unillustrated optical system forms and outputs light image 3 so that a static latent image corresponding to the light image is formed on the photoreceptor surface. This static latent image is visualized, or developed in the next step, i.e., by developing device 4. In the present invention, development is carried out with a mono component toner and the toner is selectively attracted by static electric force, for example, to the static latent image formed on the photoreceptor surface, thus the development is performed.

The developed toner image thus formed on the photoreceptor surface is electrostatically transferred to sheet P being conveyed appropriately in synchronization with the rotation of photoreceptor 1, by transfer device 5 located in the transfer area. Transfer of the toner image to sheet P is carried out by transfer device 5 by supplying the rear side of sheet P with charge of a polarity opposite to that of the toner.

After transfer, part of the toner image has been untransferred and remains on the photoreceptor surface. This leftover toner is removed by cleaning device 6 from the photoreceptor surface. Then, the remaining charge on the photoreceptor surface is erased to a uniform potential level, e.g., about 0 volt, by means of erasing device 7 for the next use of photoreceptor 1.

Sheet P after transfer is separated from photoreceptor 1 and conveyed to fixing device 8. In fixing device 8, the toner image on paper P is fused and pressed and fixed to paper P under the pressure acting between the rollers. The paper passing through fixing device 8 is discharged as an image formed sheet P to the output tray, arranged outside the image forming apparatus.

(The configuration of the developing device of the present invention)

Referring next to FIG. 3, the configuration of the developing device of the present invention will be described. That is, a configurational example of a developing device of a mono component toner of the present invention will be explained in detail.

To begin with, the structure of the developing device performing development of a mono component toner is described with reference to FIG. 3. Developing device 4 comprises: a developing roller 41 which is arranged rotatably in a developer hopper 40 holding a mono component toner, e.g., a non-magnetic mono component toner 10; and a supplying roller 42 for supplying mono component toner 10 to the developing roller side. Further, arranged on the right side in the drawing of developer hopper 40 are a pair of screw rollers 9 which re-supply mono component toner 10, as necessary, into developer hopper 40.

Developing roller 41 arranged inside developer hopper 40 is partially exposed outside and is rotated so as to convey the toner to the developing area opposing photoreceptor 1, in such a manner that the surface of the roller moves in the same direction as that of the movement of the photoreceptor surface as shown in the figure. The aforementioned supplying roller 42 is put in press contact with developing roller 41 in the area opposite to the developing area.

Developing roller 41 is configured of, for example, a metal roller (including a rotational shaft) and a porous elastic material, such as sponge, coated on the surface of the metal roller. When high polymer polyurethane foam with carbon dispersed therein or ion-conductive solid rubber is used for the elastic material such as sponge, the resistance of the roller surface can be maintained within a specified range which inhibits the occurrence of toner fusing, leading to advantages when the developing bias voltage is applied, as will be described later. The specific example of developing roller 41 used in the present invention will be described later.

This developing roller 41 is coupled with an unillustrated driving motor, and is rotationally driven in the direction indicated by the arrow in the figure. Mono component non-magnetic toner 10 is attracted to the surface of rotating developing roller 41 and is conveyed to the developing area opposing the photoreceptor surface. Since developing roller 41 is put in pressing contact with the photoreceptor surface, the pressed contact area constitutes the developing area where the static latent image on the photoreceptor surface attracts mono component toner 10 and thus it is developed.

Mono component toner 10 is a mono component non-magnetic toner having a mean particle size of about 10 $\mu$m, for example, and is of a polyester toner or styrene acrylic toner.

Applied to developing roller 41 is a developing bias voltage Va from a developing bias voltage power circuit 11. This developing bias voltage Va is set at an appropriate voltage of a polarity so that the toner will adhere to the static latent image formed on photoreceptor 1 while the toner will not adhere to areas other than that, i.e., the non-image area.

Supplying roller 42 is rotationally driven in such a manner that the surface of the supplying roller moves in the opposite direction as that of the movement of the developing roller surface, at the opposed area (pressed contact area) with developing roller 41. This supplying roller 42 is configured of a similar material to that of developing roller 41 and adjustment as to electric resistance can be carried out by similar resistance adjustment materials to that of developing roller 41. In order to further increase the elasticity of supplying roller 42, the roller is formed of a foamed material using a greater amount of a foaming agent than that of the developing roller.

Applied to supplying roller 42 is a supplying bias voltage Vc from a bias voltage power circuit 12. This bias voltage is typically set so that the toner will be urged toward the developing roller side, that is, the toner on the supplying roller side will be repulsively supplied to developing roller 41. When, for example, a negatively charged toner is used, a supplying bias voltage Vc which is further biased towards the negative side is applied to supplying roller 42.

Developing roller 41 and supplying roller 42 are coupled to an unillustrated driving motor so that they are rotationally driven in the directions of arrows in the figure. Thus, supplying roller 42 supplies the toner to developing roller 41 and also separates or removes the residual toner from the surface of developing roller 41 which has not been used for development, after the development step. Before toner 10 supplied by supplying roller 42 and adhering to the developing roller surface is conveyed to the developing area where the toner opposes the photoreceptor surface, the toner is pressed appropriately by the developing roller 41 and then the adhered amount of toner is regulated by a blade 43 as a means for regulating the adhered amount of toner so that the toner layer is constant in thickness.

Blade 43 is pressed against developing roller 41 with an appropriate pressure. This blade 43 is formed of a plate-like metal material, and the flat (side) portion near the distal end is put in press contact with developing roller 41. Therefore, toner 10 supplied to developing roller 41 is conveyed to the developing area where the toner opposes photoreceptor 1 whilst being controlled depending upon the predetermined pressure and set position of blade 43 so that the toner may have a desired amount of static charge and a desired thickness.

Blade 43 as the regulating means is fixed at one end on the developer hopper side while the flat portion on the other free end is pressed against the developing roller surface. This regulating means 43 is configured of a metal plate, such as of phosphor bronze, stainless steel (SUS), or the like, having a plate thickness of about 0.1 to 0.2 mm, and abuts a flat portion of itself in proximity to its free end against developing roller 41 with the predetermined pressure along the longitudinal direction (across the rotational shaft of the developing roller). Thus, by regulating means 43, the amount of mono component toner 10 supplied from supplying roller 42 and supported on the developing roller surface can be regulated to be constant and the thus regulated toner is conveyed to the developing area where it is in contact with photoreceptor 1.

This blade 43 also has a predetermined blade bias voltage Vb applied from a bias voltage power circuit 13. This blade bias voltage Vb is also set so that toner 10 will be urged toward the developing roller side. For example, when a negatively charged toner is used, a voltage which is further biased toward the negative side is applied to the blade. Blade bias voltage Vb applied to blade 43 may be set equal to developing bias voltage Va applied to developing roller 41 or may be greater in absolute value than that.

Toner 10 conveyed to the developing area where the toner opposes photoreceptor 1 selectively adheres to the static latent image formed on the photoreceptor surface so as to develop the static latent image with the color of toner. Part of toner 10 which has not been used for development is returned into developer hopper 40 by the rotation of developing roller 41. A toner's charge erasing means 44 is arranged in press contact with developing roller 41 at the position where the unused toner is collected. This erasing means 44 is located upstream of supplying roller 42 with respect to the rotational direction of developing roller 41 and one end is fixed to developer hopper 40 so that it abuts developing roller 41 with an appropriate pressure while the flat portion on the free end side is abutted against developing roller 41 by using its spring property.

The remaining toner after development which has not been used for development is charge erased by the combined function of the rotation of developing roller 41 and erasing means 44 when the toner is collected into developer hopper 40 so that the toner can be reused. Applied also to erasing means 44 from a power circuit 14 is erasing means bias voltage Vd for charge erasing of the toner.

In the above way, developing device 4 conveys toner 10 to the area where it opposes photoreceptor 1 and visualizes the latent image on the photoreceptor surface. The toner image on this photoreceptor surface is transferred to sheet P being conveyed as appropriate in the transfer area by the function of transfer device 5 as already stated, and then the paper is discharged passing through fixing device 8 to the exterior of the image forming apparatus.

Photoreceptor 1 used here may be an OPC photoreceptor which comprises a conductive substrate made up of metal or resin, an under layer coated on the surface of the substrate, a carrier generating layer (CGL) coated thereon as the middle layer and a carrier transfer layer (CTL) mainly composed of polycarbonate coated thereon as the topmost layer. However, the photoreceptor in the present invention is not limited to this, and any photoreceptor can be used as long as it is a bearer that can support the static latent image.

Next, specific configurations of developing roller 41, supplying roller 42, blade 43, etc., constituting developing device 4 of the present invention will be described.

(The configuration of the developing roller)

Developing roller 41 is configured as already described. A further detail of its configuration will be described. Developing roller 41 comprises a metal shaft, for example, a stainless shaft 41*a* coated with a conductive urethane rubber having a conductionizing agent such as carbon black added therein and having a volume resistivity of about $10^6$(Ωcm) and a JIS-A hardness of 60 to 70 degrees. Developing roller 41 is in contact with photoreceptor 1 with a contact depth of 0.1 to 0.3 mm with a toner layer in between and is rotated in the direction of the arrow by an unillustrated driving motor.

Developing roller 41 has a developing bias voltage Va applied at its shaft 41*a* from developing bias power circuit 11. When the mono component toner is a negatively charged type, a developing bias voltage Va of −450(V) is applied, for example.

(The configuration of the supplying roller)

Supplying roller 42 performs both agitation of the toner stored in developer hopper 40 and removal of the toner remaining on the surface of developing roller 41 after development by developing roller 41. This supplying roller 42 is composed of a rotational shaft 42*a* and a conductive, porous foam material coated on the shaft.

The porous foam material is a conductive urethane foam having a volume resistivity of about $10^5$ Ωcm, a cellular density of pores of 80 to 140 cells/inch and a hardness ranging from 60 degrees on Asker F basis to 30 degrees on Asker C basis. This urethane foam is mixed with carbon black in such a ratio that 5 to 15 parts by weight of carbon black is blended to 100 parts by weight of the foam. In some embodiments, about 70 parts by weight of carbon black may be blended. Polyurethane foam and carbon black are the same as used in developing roller 41.

In order to obtain the foam material having the above cellular density, polyurethane foam and carbon black, for example, are mixed and the mixture is stirred by a stirrer so as to be foamed, then the foam is coated around the metal rotational shaft 42*a* (having the same composition as developing roller 41) by heat blow molding, thus forming a supplying roller 42.

Supplying roller 42 is in press contact with developing roller 41 with a contact depth of about 0.5 to 1 mm and is rotationally driven in the direction of the arrow by an unillustrated driving motor. Supplying roller 42 has a supplying bias voltage Vc (e.g., −550 V) applied from toner supplying bias voltage circuit 12 via stainless steel shaft 42*a*.

(The configuration of the blade in the toner layer thickness regulating means)

Blade 43 is fixed at one end to developer hopper 40 as shown in FIG. 3 forming a cantilever having the predetermined length while the other free end being pressed with an appropriate pressure against developing roller 41. By this arrangement, the toner is tribo-electrified so as to have charge suitable for development while the amount of the toner adhering to developing roller 41 is regulated so as to be constant.

Blade 43 is fixed at one end to developer hopper 40 so that the other end abuts developing roller 41 by virtue of its spring property, for example. This blade 43 is a metal plate of about 0.05 to 0.5 mm thick and abuts developing roller 41 with the predetermined pressure produced by virtue of the spring property of the material, that is, by the elastic deformation, so as to create a toner layer having the predetermined thickness and the predetermined amount of static charge.

The distal end of blade 43 abutting developing roller 41 is bent in the direction away from the developing roller surface, forming a micro bevel so that the angle formed between the developing roller and the bent blade 43 becomes greater. The abutment area of blade 43 on developing roller 41 may be processed with some coating or other treatments in order to control the amount of static charge on the toner and prevent the toner from fusing.

Blade 43 may be formed of any usual material which has spring properties. Examples of the material include spring steel such as SUS, stainless steel such as SUS301, SUS304, SUS420J2, SUS631, and copper alloys such as C1700, C1720, C5210, C7701.

The micro bevel surface at the free end of blade 43 may be formed by mechanical cutting, abrading, bending, or may be formed by applying a chip-like tip having a desired shape pre-formed by molding, using a conductive adhesive, or may be formed by shaping a stepped portion in the blade tip and applying metal foil thereon using a conductive adhesive.

The blade has a blade bias voltage Vb (e.g., −500 V) applied from toner layer thickness regulating bias voltage circuit 13.

Figure 5:
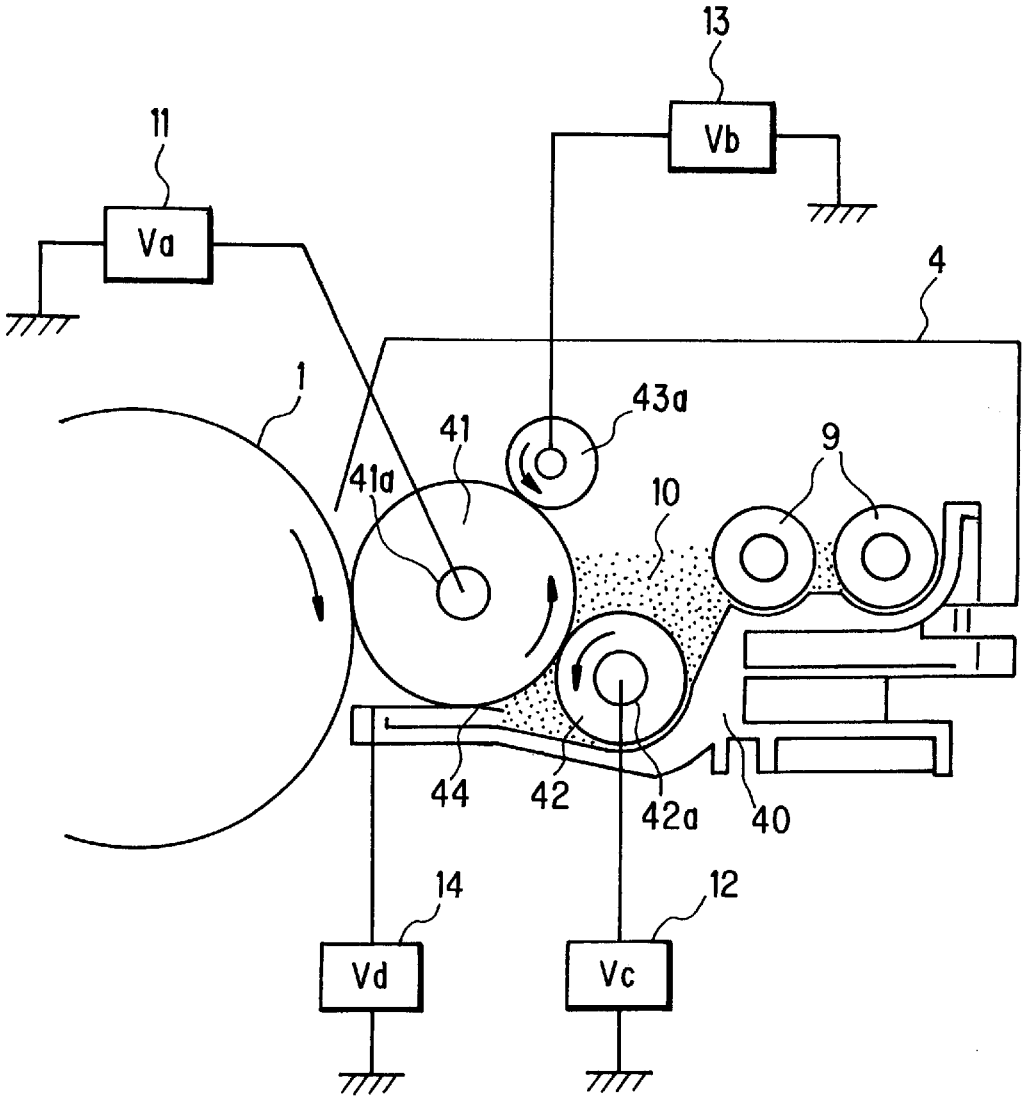
FIG. 5 is a sectional view showing a variation of a developing device shown in FIG. 3.

The above blade 43 is not limited to a plate shape but may also be formed of a roller as shown in FIG. 5. The roller configuration of blade 43a shown in FIG. 5 can enhance prevention of toner fusing and lengthen the life of the regulating means.

This roller blade 43*a* is formed of a metal material or hard resin material. Roller blade 43*a* is rotated in the same direction as developing roller 41, that is, in the counter-clockwise direction in FIG. 5 so as to regulate the amount of the toner which has been supplied by supplying roller 42 on developing roller 41. Similarly, roller blade 43*a* has a blade bias voltage Vb (−500 V) from toner layer thickness regulating bias voltage circuit 13 via the roller shaft thereof.

(The configuration of the erasing means)

Erasing means 44 is pressed against developing roller 41 as shown in FIGS. 3 and 5 being in direct contact with the toner after development so as to prevent toner leakage and erase static charge from the toner to thereby separate the toner from developing roller 41 for the next use. Erasing means 44 is formed of a plate-like elastic element and is pressed against developing roller 41 with an appropriate pressure in the same manner as blade 43. The erasing means has an erasing means bias voltage Vd applied from power circuit 14 so as to eliminate the charge of the collected toner after development.

Erasing means 44 is formed of an electrically conductive film of 0.3 mm±0.1 mm thick and having an electric resistance of $10^3$ to $10^6$ Ω and is set at the same potential as that applied to developing roller 41 or has an erasing means bias voltage (Vd), higher by about 50 V or more than the potential of developing roller 41, applied from toner's charge erasing bias voltage circuit 14.

Erasing means 44 may be formed of an electrically conductive material such as aluminum-metalized film. Alternatively, if no erasing of charge from the toner is necessary, an insulative film such as Mylar film may be used aimed at only bottom sealing. In this case, no erasing power circuit 14 is needed.

In connection with this, because of the effective roller resistance (r) of developing roller 41 and the development current (I) flowing during development, a voltage drop of $V=I\times r$ will occur inside developing roller 41. Therefore, it is possible to lower the effective developing bias applied to the developing roller surface, by adjusting the effective roller resistance appropriately, so that the development characteristics of harsh two tones can be modified into a desired graduation of tones.

(The non-magnetic mono component toner)

The toner as the non-magnetic mono component developer can be obtained by mixing 80 to 90 parts by weight of styrene-acrylic copolymer, 5 to 10 parts by weight of carbon black, and 0 to 5 parts by weight of a charge control agent, kneading the mixture, crushing and classfying, thus producing a negatively charged toner having a mean particle size of about 5 to 10 μm. In order to improve fluidity of the toner, 0.5 to 1.5 parts by weight of silica ($SiO_2$) is internally or externally added, thus producing the desired non-magnetic mono component toner.

The toner is not limited to negatively charged type but a positively charged toner may be obtained. This can be easily obtained by appropriate selection of a main binder resin and charge control agent. The toner is not limited to black toner for monochrome copiers and printers but color toner for color copiers and printers may be used.

Non-magnetic mono component toner is not limited to the above composition but the composition shown hereinbelow may be applicable to the developing device of the invention.

As a thermoplastic resin for the main component binder resin, polystyrene, polyethylene, polyester, low-molecular weight polypropyrene, epoxy, polyimide, polyvinyl butyral or the like may be used in place of styrene-acrylic copolymer.

As the coloring agent, furnace black, nigrosine dyes, metal contained dyes or the like may be used in place of carbon black in the case of a black toner. For color toner, examples for yellow toner include benzidine yellow pigment, phonon-yellow, acetoacetic anilide insoluble azo pigments, monoazo pigments, azomethine dyes. Examples for magenta toner include xanthene magenta dyes, phosphorous wolframate-molybdate lake pigments, anthraquinone dyes, coloring material consisting of xanthene dyes and organic carboxylic acid, thioindigo, Naphtol insoluble azo pigments. Examples for cyan toner include copper phthalocyanine pigments.

Examples of toner fluidizer include, other than silica as an external additive, colloidal silica, titanium oxide, alumina, zinc stearate, polyfluorovinylidene and combinations thereof.

Further, examples of charge control agent for negatively charged toner include azo metal-contained dyes, organic acid metal complex and chlorinated paraffins. Examples for positively charged toner include nigrosine dyes, fatty acid metallic salts, amines and quaternary ammonium salts.

In developing device 4 using the thus configured mono component toner, the adhered amount of toner 10 is regulated by blade 43 in pressing contact with developing roller 41 so that the toner layer will have a uniform thickness. Thereafter, toner 10 is conveyed to the developing area and develops the static latent image on the photoreceptor surface. During this process, development roller 41, supplying roller 42 and blade 43 are applied with respective bias voltages, namely, developing bias voltage Va, blade bias voltage Vb and supplying bias voltage Vc.

(The first embodiment of the present invention)

In developing device 4 of the present invention, supplying roller 42, which supplies the toner to developing roller 41 and provides predetermined static charge to the toner by tribo-charging, is pressed with a predetermined pressure against developing roller 41 on the site opposite to the developing area. In this case, supplying roller 42 is pressed against developing roller 41 with a contact depth of about 0.5 to 1 mm, as stated above.

This setting allows supplying roller 42 to press developing roller 4 in a beneficial manner so that the toner can be supplied uniformly in a stable manner and tribo-charged uniformly across the full length of the roller.

As shown in FIG. 3, supplying roller 42 is rotated counterclockwise in such a manner that the surface of the supplying roller moves in the opposite direction to that of the movement of the developing roller surface, at the contact area. As shown in FIGS. 1A and 1B and FIGS. 2A and 2B, rotational shaft 42*a* of supplying roller 42 is driven by driving elements or gears 47 which are coupled with a pair of driven elements or gears 46 at both ends of shaft 42*a*. Driving gears 47 are coupled with and driven by an unillustrated driving motor so as to rotate supplying roller 42 in the direction shown in the figure.

In the thus configured developing device 4, while supplying roller 42 is put in press contact with developing roller 41, supplying roller 42 is driven separately from developing roller 41. Therefore, as shown in FIGS. 2A and 2B, both ends of rotational shaft 42*a* of supplying roller 42 are rotatably supported by bearings 45 held by developer hopper 40. A pair of driven gears 46 are fixed on the shaft at portions further outwards from developer hopper 40. It is usual to provide a single driven gear 46 at one end of rotational shaft 42*a* in order to drive supplying roller 42. In the present invention, however, a pair of driven gears 46 are provided on both sides.

As shown in FIGS. 1A and 1B, each driven gear 46 is meshingly coupled with and rotationally driven by driving gear 47 which is rotated by an unillustrated driving motor in the direction shown in the figures. Developing roller 41 is also rotationally driven, separately from supplying roller 42, by the rotation of an unillustrated driving motor, in the direction of the arrow.

Referring to FIG. 1A, the position where driving gear 47 and driven gear 46 of the present invention mesh with each other is located on the downstream side of the contact point between developing roller 41 and supplying roller 42 with respect to the rotational direction of supplying roller 42 or on the lower side with respect to a line passing through the shaft center A of developing roller 41 and the shaft center B of supplying roller 42. Here, in FIG. 1A, the upper and lower sides of a line AB passing through the shaft center A of developing roller 41 and the shaft center B of supplying roller 42 are termed as the upstream side and the downstream side with respect to the rotational direction of supplying roller 42, respectively.

Now, when driven gear 46 for rotating supplying roller 42 is coupled with driving gear 47 at the position on the downstream side, as shown in FIG. 1A, a force F0 acts rightward along the tangent (in the rotational direction). That is, this force F0 acts in such a direction as to draw supplying roller 42 away from developing roller 41. More specifically, acting force F0 can be decomposed into two components F1 and F2, F1 being a force parallel to line AB passing through the shaft center A of developing roller 41 and the shaft center B of supplying roller 42 and F2 being a force perpendicular thereto. Thus, depending upon the magnitude and the direction of acting force F0, supplying roller 42 deflects with respect to bearings 45 as its fixed supports.

Illustratively, as shown in FIG. 2A, when driving gears 47 and driven gear 46 are meshingly coupled with each other as shown in FIG. 1A, acting force F0 is oriented in the direction opposite to the position of developing roller 41, or oriented in the direction away from the developing roller. Therefore, supplying roller 42 deflects with respect to bearings 45 as its fixed supports and deforms toward the direction opposite to the force F0 acting at the coupling position between driving gear 47 and driven gear 46. That is, supplying roller 42 deflects toward the developing roller side. In particular, since acting force F0 acts on each of driven gears 46 arranged at both ends of shaft 42*a* of supplying roller 42 so as to press them to the direction opposite to the developing roller side, as shown in FIG. 2A, the middle part of supplying roller 42 deflects toward the developing roller side with the points of the bearings being fixed, as indicated by the broken line.

Accordingly, supplying roller 42 with no crowned surface abutting developing roller 41 is pressed against developing roller 41 as if it were in reality crowned. As a result, supplying roller 42 can be rotationally driven whilst being pressed approximately uniformly against developing roller 41 along shaft 42*a*. Therefore, it is no longer necessary to press supplying roller 42 against the developing roller, thus leading to a reduction of load torque.

On the other hand, as shown in FIG. 1B, when driven gear 46 for supplying roller 42 is coupled with driving gear 47 at the position on the upstream side, as shown in FIG. 1B, a force F0 due to the rotation of driving gear 47 acts toward the developing roller side.

As a result, as shown in FIG. 2B, driven gears 46 at both ends of supplying roller 42 are urged toward the developing roller 41 side by acting force F0 due to the rotation of driving gears 47. Therefore, the middle portion of supplying roller 42 deflects in the direction away from developing roller 41 with respect to bearings 45 as its fixed supports. This not only degrades the uniformity of the pressing contact of supplying roller 42 with developing roller 41 but also makes it impossible to supply the toner to developing roller 41 and to remove the residual toner on developing roller 41 after development.

In order to verify the above effect of the present invention, actual copying operations were carried out using a developing device described in the embodiment hereinbelow.

(Embodiment)

Actual copying operations were performed by rotationally driving supplying roller 42 by way of driving gears 47, with the coupling position between driving gear 47 and driven gear 46 on the supplying roller side set at eight different points, i.e., B1 to B8 shown in FIG. 1B. In this actual operation, the uniformity of the toner image and image voids on the sheet were checked. The result, in particular, revealed marked image voids and density variations in the middle part of the sheet.

For this purpose, the following configuration was used. Developing roller 41 was a conductive elastic roller with a diameter of 34 mm formed of a conductive urethane rubber and having a volume resistivity of about $10^6$ Ωcm and a JIS-A hardness of 60 to 70 degrees with a surface roughness Rz of 3 to 6 pm conforming to JISB-0601. This developing roller 41 was put in contact with photoreceptor 1 with a contact depth of 0.1 to 0.3 mm and rotated at a peripheral speed of 285 mm/s in the direction of the arrow in FIG. 3. Rotational shaft 41*a* of developing roller 41 was stainless steel having a diameter of 18 mm and applied with a developing bias voltage Va of −450 V from developing bias power circuit 11.

Supplying roller 42 was configured of a conductive elastic foam roller made up of a stainless steel rotational shaft 42*a* having a diameter of 8 mm coated with a conductive urethane foam having a volume resistivity of about $10^5$ Ωcm and a cellular density of 80 to 100 cells /inch and having a diameter of 20 mm. This supplying roller 42 was put in contact with developing roller 41 with a contact depth of about 0.5 to 1 mm and was rotated at a peripheral speed of 170 mm/sec in the direction of the arrow in FIG. 3. Rotational shaft 42*a* of supplying roller 42 was of stainless steel and applied with a supplying bias voltage Vc of −550 V from power circuit 12.

Blade 43 or the regulating means was configured of a stainless steel plate of about 0.1 mm thick and was pressed in contact with developing roller 41. This blade 43 has a cantilever leaf-spring configuration so that the free end side was abutted against developing roller pressing the toner layer on the developing roller 41 surface with the predetermined pressure produced by its elastic deformation. A blade bias voltage Vb of −500 V was applied to this blade 43 from power circuit 13.

Further, erasing means 44 was configured of an electrically conductive film of a resin substrate with carbon particles dispersed therein with a thickness of 0.3 mm±0.1 mm and having an electric resistance of $10^3$ to $10^6$ Ω and put in surface contact with developing roller 41 with the predetermined pressure produced by its inherent elasticity. An erasing means bias voltage Vd of −500 V was applied to this erasing means 44 from power circuit 14.

Toner 10 used was a mono component non-magnetic, black toner of a negatively charged type of styrene acrylic toner having a diameter of about 10 μm. Photoreceptor 1 was one having an organic photoconductive layer with a diameter of 65 mm and rotating in the direction of the arrow in FIG. 3 at a peripheral speed of 190 mm/sec. Photoreceptor 1 was charged by charger 2 at a surface potential of −550 V.

In this configuration, actual copying operations were done and the results are shown in Table 1 below. In particular, the results show different coupling positions B1 to B8 where driving gear 47 is meshingly coupled with driven gear 46. In Table 1, coupling angle θ is determined based on the point B1 as 0°. The coupling angle θ is an angle created by line AB joined between the center A of shaft 41*a* of developing roller 41 and the center B of shaft 42*a* of supplying roller 42 and a line BC joined between the shaft center C of driving gear 47 and the shaft center B of driven gear 46. Coupling position B1 is the position opposite to the opposed position (contact position) between developing roller 41 and supplying roller 42, and this position is set as 0°. The above coupling positions B1 to B8 were set apart from one to the next by 45 degrees in the rotational direction of supplying roller 42.

TABLE 1

| Coupling position | B1 | B2 | B3 | B4 | B5 | B6 | B7 | B8 |
|---|---|---|---|---|---|---|---|---|
| Coupling angle θ | 0° | 45° | 90° | 135° | 180° | 225° | 270° | 315° |
| Uniformity over entire sheet | Fair | Bad | Bad | Bad | Fair | Good | Best | Good |

When driving gear 47 is meshed with driven gear 46 at positions B1 and B5, force F0 acting due to the rotation of driving gear 47 is approximately perpendicular to line AB. In these cases, supplying roller 42 deflects but not relative to developing roller 41, so the abutment state with developing roller 41 was almost fair with no marked influence on the image quality. Better results could be obtained when the coupling position between driving gear 47 and driven gear 46 was set at points B5 to B8.

The best result was obtained when the coupling position was set at point B7 where line AB (the line joined between the shaft center A of developing roller 41 and the shaft center B of supplying roller 42) was perpendicular to line BC (the line joined between the shaft center B of supplying roller 42 and the shaft center C of driving gear 47) and driving gear 47 meshing with driven gear 46 was rotated in the direction indicated by the arrow. At this point, the abutment state of supplying roller 42 against developing roller 41 became stable, enabling uniform charging and uniform toner supplying and effective removal of the residual toner after development, which are believed to be the reasons for the excellent result. In this case, force component F1 coincides with force F0 or acting force F0 becomes parallel with line AB, and so the force component F1 is maximized.

In this way, the force component F1 shown in FIG. 2A becomes maximum, so that an insufficient pressure around the middle part of supplying roller 42 is compensated for, realizing a preferable result. With this configuration, a further reduction in pressing force of supplying roller 42 against developing roller 41 makes it possible to perform uniform toner supplying and uniform charging of the toner along the axial direction, producing a beneficial developed image. Resultantly, driving torque of supplying roller 42 can be further reduced.

From the above, preferable toner supply and toner charging can be realized when the coupling position of driving gear 47 to be coupled with and rotate driven gear 46 is set on the downstream side of the contact point between developing roller 41 and supplying roller 42 with respect to the rotational direction of supplying roller 42 or below the line AB, that is, when the coupling angle θ is set so that 180°≦θ≦360° with the coupling angle at point B1 is 0°. The favorable state is realized within the range of 225°≦θ≦315° and the best result can be obtained when the coupling angle θ is equal to 270°, that is, when driving gear 47 is coupled with driven gear 46 so that the line joined between the center of driving gear 47 and the center of supplying roller 42 is set perpendicular to the line joined between the center of developing roller 41 and the center of supplying roller 42.

Here, since supplying roller 42 is rotated so that its peripheral movement is opposite to that of developing roller 41 at the contact area, the electrification of the toner is improved and scraping of the toner remaining after development on developing roller 41 can be further improved.

In the actual copying operations, the rotational speed of supplying roller 42, that is, the peripheral speed, was set at 170 mm/sec, which was slow enough compared to 285 mm/sec, the rotational speed of developing roller 41 at its periphery. With this setting, the driving torque (load torque) for rotating supplying roller 42 is reduced so that the roller can be driven readily by a motor having a low driving torque. In addition, though there is a problem of developing roller 41 and supplying roller 42 being worn at the pressing contact area therebetween, the wear of supplying roller 42 can be significantly reduced.

In this case, the supplied amount of toner reduces due to reduction in peripheral speed of supplying roller 42. To compensate the reduction, a lower voltage (greater in its absolute value) than the bias voltage to developing roller 41 is applied to supplying roller 42 so that the negatively charged toner will be able to transfer to developing roller 41. This feature prevents toner supply failure due to slow speed of the rotation and enables sufficient toner supply.

If the rotational speed of supplying roller 42 is increased, consequently the amount of toner supply increases. So, the bias voltage applied to supplying roller 42 can be set equal to the developing bias voltage to developing roller 41. In this case, power circuit 12 provided for supplying roller 42 in FIG. 3 can be omitted and the output voltage from power circuit 11 can be shared with supplying roller 42. Therefore, the power circuit can be simplified.

(Another embodiment of the present invention)

As has been described, in the first embodiment of the present invention, the rotational driving means of supplying roller 42 is manipulated so as to stabilize toner supply to developing roller 41 and charging of the toner.

In the above configuration, in order to secure an ample amount of toner supplied by supplying roller 42 to developing roller 41, it is considered to increase the rotational speed of supplying roller 42. However, the driving torque increases with increasing speed of supplying roller 42 because the supplying roller 42 is pressed against developing roller 41.

In this embodiment, an ample amount of toner supply to developing roller 41 can be secured without increasing the rotational speed of supplying roller 42. This configuration will be described hereinbelow.

Supplying roller 42 performs both agitation of the toner stored in developer hopper 40 and removal of the toner from developing roller 41 after development by developing roller 41. Therefore, supplying roller 42 is composed of an elastic foam roller made up of conductive urethane foam. Specifically, the urethane foam is mixed with carbon black in such a ratio that 5 to 15 parts by weight of carbon black is blended to 100 parts by weight of the foam. In some embodiments, 70 parts by weight of carbon black may be blended. The polyurethane foam and carbon black are the same as used in developing roller 41.

As an example, polyurethane foam and carbon black are mixed and the mixture is stirred by a stirrer so as to be foamed, then the foam is coated around the metal rotational shaft 42*a* (having the same composition as developing roller 41) by heat blow molding, thus forming a supplying roller 42.

In the thus configured supplying roller 42, if the foam material has a lower cellular density, toner particles enter the foamed cells and harden the elastic foam material. Consequently, the driving torque for supplying roller 42 increases while the conveying capacity of toner lowers due to clogging of pores in the foam material, thus posing a problem of insufficient toner supply to developing roller 41.

Conversely, when the foam material constituting supplying roller 42 has a large cellular density, it becomes difficult for toner particles to enter the foamed cells in the elastic foam material but the conveying capacity also lowers proportionally. As a result, image density lowers due to an insufficient toner supply, and the hardness of the elastic foam material increases. Therefore, the contact pressure of supplying roller 42 against developing roller 41 becomes higher and hence the driving torque increases. In addition, the toner is subject to receive mechanical stress and becomes liable to be degraded.

Thus, the cellular density of the elastic foam material constituting supplying roller 42 is one of the significant factors which can improve toner supply as well as reduce the driving torque. Therefore, limitation of the cellular density of the elastic foam material of supplying roller 42 within the predetermined range makes it possible to realize stable toner supply and reduction of the driving torque, as stated above.

In this view, stabilized toner conveyance and toner supply for producing a high enough development density could be secured by limiting the cellular density of supplying roller 42 of the present invention to a range of 80 to 100 cells/inch, as shown in Table 2.

TABLE 2

| Cellular Density (cells/in.) | 60 | 80 | 100 | 120 | 140 | 160 | 180 |
|---|---|---|---|---|---|---|---|
| Image Density | Bad | Good | Good | Bad | Bad | Bad | Bad |

Good: No image density lowering was found.
Bad: Image density lowering on printed sheet was found.

In the configuration of the present invention, supplying roller 42 made up of an elastic foam material is put in contact with developing roller 41. In this case, the developing roller 41 used has a greater hardness than supplying roller 42. As an example, developing roller 41 is usually made up of an elastic solid rubber or a metal sleeve, as already stated above. Therefore, in the contact area between developing roller 41 and supplying roller 42, the supplying roller using an elastic foam material having a lower hardness than developing roller 41 is mainly deformed so that the features of the contact area are much dependent upon the hardness of supplying roller 42.

Accordingly, if the contact depth between supplying roller 42 and developing roller 41 is specified at a predetermined value, the pressure in the contact area with developing roller 41 will necessarily increase with increasing hardness of supplying roller 42. Conversely, with a lower hardness of supplying roller 42, the pressure in the contact area will lower.

In accordance with the present invention, the hardness of the elastic foam material of supplying roller 42 is limited to within a range from 60 degrees on Asker F basis to 30 degrees on Asker C basis. This setting realizes a low enough hardness of the supplying roller compared to developing roller 41 so as to lower the contact pressure while securing the predetermined contact area or contact depth, thus alleviating the driving torque. It is also possible to maintain the function of removing the residual toner from developing roller 41 by the thus set, predetermined contact depth. Moreover, the hardness is set so as to make it possible to efficiently perform toner supplying to developing roller 41 as well as removal of the toner.

In the above described embodiment, for a negatively charged toner, the voltages applied to developing roller 41, supplying roller 42 and the regulating means or blade 43 are set at −450 V, −550 V and −500 V, respectively. In particular, the potential difference between developing roller 41 and supplying roller 42 is set not more than 100 V which is lower than the discharge starting voltage so as to prevent occurrence of discharge between developing roller 41 and supplying roller 42 while promoting the toner to transfer to developing roller 41, thus eliminating the toner supply failure in a positive manner. By this configuration, it is possible to realize stabilized charging of the toner without relying on the aforementioned electric discharge and realize stable toner supply, thus providing a correct amount of static charge to the toner.

Further, since toner 10 is of a non-magnetic type and hence contains fewer amounts of substances that disturb coloring of coloring agents, a toner having a desired color can be prepared easily, thus making it possible to produce toners for color image formation. As compared to the magnetic toner, the toner of the present invention does not contain any magnetic substance, so that the toner is excellent in charging stability and is enhanced in capability of bearing static charge, hence enabling preferable development.

In accordance with the developing device of mono component toner of the present invention, the rotational driving of the supplying roller for charging the toner and supplying it to the developing roller which supports the toner and conveys it to the development position on the image bearer holding the latent image, is taken into consideration. Therefore, a beneficial pressing state of the supplying roller against the developing roller can be realized so as to achieve stable toner supply and correct charging of the toner, making it possible for preferable development with a mono component toner.

Also, the driving torque of the supplying roller can be reduced without the necessity of a crowned configuration for improving the pressing state of the supplying roller against the developing roller. Therefore, it is possible to stably supply the toner using a simply configured supplying roller, thus leading to reduction in cost and size of the apparatus including driving motors.

Further, as the composition of the elastic foam material for the supplying roller, the foamed cellular density of the foam material is limited, so that it is possible to further improve the pressing state against the developing roller without increasing pressing force, to thereby realize beneficial toner supply and enhance the electrification performance of the toner as well as to perform effective removal of the residual toner after development.

What is claimed is:

1. A mono component toner developing device, comprising:

a developing roller supporting and conveying the mono component toner to a developing area opposing a static latent image bearer; and a supplying roller disposed opposing the developing roller on the side opposite to the developing area for supplying the toner to the developing roller, the supplying roller has a pair of driven elements arranged at both ends of a rotational shaft thereof for being rotationally driven while a pair of driving elements to be coupled with corresponding ones of the pair of driven elements to transmit a rotational force thereto are coupled with the ones of the pair of driven elements at a position where the driving elements urge the one of the pair of driven elements in the direction opposite an opposing point between the developing roller and the supplying roller.

2. The mono component toner developing device according to claim 1, wherein the supplying roller is rotationally driven in a direction that its peripheral movement is opposite to that of the developing roller at their opposed point, and each driving element and driven element are coupled in such manner that, when a coupling angle θ is the angle defined at a shaft center of the supplying roller by a line joined between the shaft center of the supplying roller and a shaft center of the developing roller and a coupling point between the driving element and a shaft center of the driven element, the coupling angle θ of the driving element is set so that $180° \leqq \theta \leqq 360°$ where the coupling angle when the coupling point resides on the line and on the side opposite to the developing roller is 0°.

3. The mono component toner developing device according to claim 1, wherein the driving elements are coupled with the one of the pair of driven elements at a point on a line passing through a shaft center of the supplying roller and being perpendicular to the line joined between a shaft center of the developing roller and the shaft center of the supplying roller.

4. The mono component toner developing device according to claim 1, wherein the supplying roller is configured of an elastic foam material having many pores therein with a cellular density of pores falling within 80 to 100 cells/inch.

5. The mono component toner developing device according to claim 4, wherein the hardness of the supplying roller is lower than that of the developing roller and is set within a range from 60 degrees on Asker F basis to 30 degrees on Asker C basis.

* * * * *